United States Patent [19]

Schuetze

[11] 4,413,368

[45] Nov. 8, 1983

[54] COMBINATION BEDSPREAD AND SLEEPING ENCLOSURE

[76] Inventor: Nina Schuetze, 10108 Homeland Ave., Whittier, Calif. 90603

[21] Appl. No.: 318,830

[22] Filed: Nov. 6, 1981

[51] Int. Cl.[3] ..... A47G 9/00

[52] U.S. Cl. ..... 5/494; 5/413; 5/502

[58] Field of Search ..... 5/413, 485, 494, 496, 5/482, 486, 495, 498, 497, 499, 500, 502

[56] References Cited

U.S. PATENT DOCUMENTS

| | | | |
|---|---|---|---|
| 1,502,608 | 7/1924 | Young | 5/494 |
| 1,964,271 | 6/1934 | O'Dwyer | 5/494 |
| 3,530,487 | 9/1970 | Beer | 5/496 |
| 3,832,743 | 9/1974 | Smith | 5/496 |
| 3,988,791 | 11/1976 | Simon | 5/413 |
| 4,014,055 | 3/1977 | Torres | 5/485 |

FOREIGN PATENT DOCUMENTS

| | | | |
|---|---|---|---|
| 1093969 | 12/1967 | United Kingdom | 5/413 |

*Primary Examiner*—Alexander Grosz
*Attorney, Agent, or Firm*—Francis X. LoJacono

[57] ABSTRACT

A combination bedspread and sleeping enclosure constructed from a matching or color-and-design-coordinated fabric, the bedspread being made to form fit the associated mattress, and including a transversely disposed fastening element located adjacent the foot end of the bed, whereby a cooperating fastening element is secured to the sleeping enclosure so as to be removably interconnected to the transverse fastening element of the bedspread. The sleeping enclosure is formed as a single, elongated cover comprising a material of double thickness which is batten filled; and the enclosure has oppositely disposed longitudinal fastening elements, each fastening element being secured along the inner side of the enclosure and being defined by male and female interconnecting elements. Thus, when the elongated cover is folded along its transverse center line, the respective fastening elements thereon will engage and establish a sleeping enclosure having one end closed and two closed sides.

4 Claims, 4 Drawing Figures

COMBINATION BEDSPREAD AND SLEEPING ENCLOSURE

BACKGROUND OF THE INVENTION

This invention relates to bedding for sleeping, and more particularly to a fitted bedspread in combination with a removable sleeping enclosure so as to eliminate the need for the typical sheets and blankets presently employed for bedding, as well as to eliminate the need for a separate spread or bed cover.

It is well known in many families with children that very often beds are left unmade, or made in a haphazard manner, leaving a great deal to be desired for the appearance of neatness. Even when children are taught to make their own beds, some will still attempt to avoid doing so. As an example, many children will sleep on top of their beds, without pulling down the bedspreads at night, so as to evade having to make their beds in the morning.

The making of a bed while on vacation seems to be an especially unpleasant task to perform, particularly when children are to spend any length of time at a beach or mountain resort. Also, it is sometimes required that one supply his or her own bedding, and this can become a cumbersome project in itself.

Thus, there is a great need for the present-disclosed simple means by which the above-mentioned problems can be readily overcome.

SUMMARY OF THE INVENTION

Accordingly, it is an important object of the present invention to overcome the typical problems of bedmaking by providing a combination bedspread and sleeping enclosure requiring a minimal amount of bedding, and to further provide an easily and quickly made bed set having the usual decorative appearance as well.

It is another object of the present invention to provide a combination bedspread and sleeping enclosure, wherein the spread section is adapted to be form-fitted over the mattress of the bed; and wherein the matching sleeping enclosure comprises a single, elongated, rectangular cover of batten-filled two-ply material, which is to be folded over so as to establish a closed foot end and an open head end, and two elongated sides that include fastening elements positioned along the opposing edges of each side, whereby the sides may be joined to form a simple one-piece enclosure covering the top of the bed.

Still another object of the invention is to provide a bedspread-and-sleeping-enclosure combination, wherein a fastening device is positioned adjacent the foot of the bed and secured to opposing surfaces between the bedspread and the sleeping enclosure, to prevent the enclosure from becoming unintentionally detached or separated from the spread while situated on top of the bed.

It is still another object of the invention to provide a combination of this character that includes color and/or design coordinated fabrics, as well as a matching pillow case.

It is a further object of the invention to provide a combination of this character that is simple yet durable in construction and that is composed of just a few pieces, whereby a bed can be made very easily and quickly.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figures 1, 2, 3, 4:
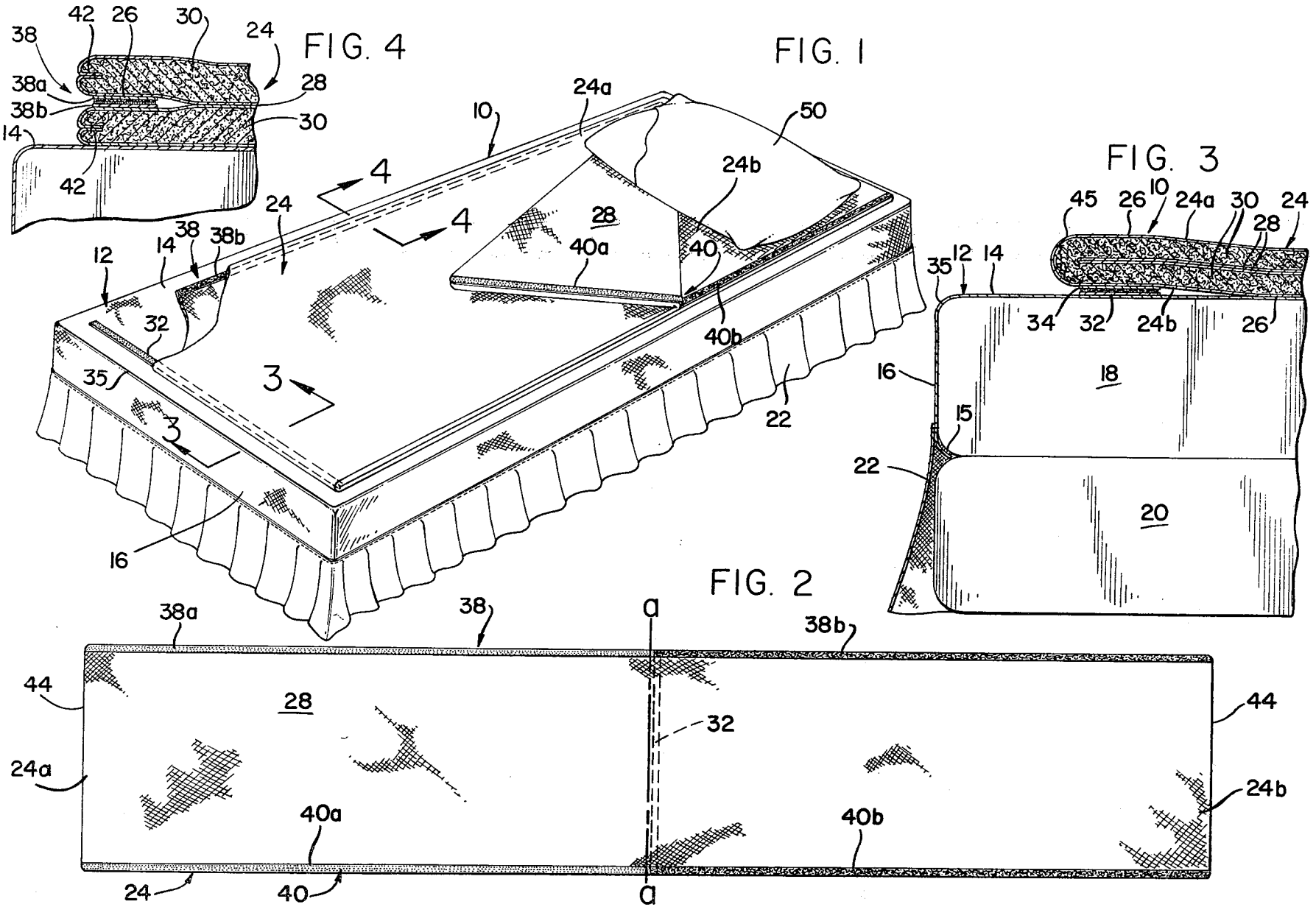
FIG. 1 is a perspective view of the present invention shown mounted to a typical bed, and having one side of the enclosure folded back and a corner thereof broken away for a more clear illustration.
FIG. 2 is a top-plan view of the enclosure laid out prior to being folded over at its center along line a—a.
FIG. 3 is an enlarged cross-sectional view taken substantially along line 3—3 of FIG. 1, showing the enclosure secured to the foot end of the fitted bedspread section.
FIG. 4 is an enlarged cross-sectional view taken substantially along line 4—4 of FIG. 1, showing the folded sections of the enclosure interconnected along the longitudinal edges thereof.

Referring more particularly to the drawings, there is shown in FIG. 1 a bed, generally indicated at 10, having mounted thereover a fitted mattress cover defined as a bedspread 12. It is contemplated that bedspread 12 will be formed from a large sheet of suitable fabric appropriately sewn so as to fashion a top mattress-cover member 14 having four depending side panels 16, whereby the overall size and configuration is such that the bedspread will be form-fitted over the mattress 18 by means of a continuous elastic band 15.

Mattress 18 is typically supported by box spring 20. In order to cover box spring 20, a depending flare or ruffle 22, made preferably from matching material, can be attached along the peripheral lower edge of bedspread 12.

Removably supported by and attached to the top of fitted bedspread 12 is a sleeping enclosure, generally designated at 24. Sleeping enclosure 24 comprises an outer cover sheet 26 and an inner cover sheet 28 which are sewn together along their mating peripheral edges, as indicated in FIG. 4. Interposed between the opposing cover sheets 26 and 28 is a suitable filler of batting material 30, preferably of an insulating type for warmth; and the cover sheets together with the filler material can be quilted. Inner and outer cover sheets 26 and 28 can be made from a single elongated sheet of fabric, or each cover sheet can be formed by joining two half sections of fabric together, whereby the two joined sections would define the transverse fold line a—a, as seen in FIG. 2.

Fastening means 32 is secured to the outer sheet 26 prior to sewing the inner and outer sheets together, the fastening means being positioned adjacent the center fold line a—a. Fastening means 32 is positioned so as to interconnect to a mating fastening means 34 secured to top cover section 14 of the bedspread 12, as seen in FIG. 3. It is contemplated that the fastening means 32 and 34 comprise the well-known male and female coupling members formed from elongated fabric strips known under the trademark Velcro.

Accordingly, one of the fastening strips 32 is secured to cover 14 transversely of the length thereof approximately four inches from the edge 35 of the foot end of cover 14; while the other fastening strip 34 is secured to the outer sheet 26, whereby strip 34 will lockingly engage strip 32, thus preventing the sleeping enclosure from slipping off the bed, but allowing the enclosure to be folded along its center.

Prior to being sewn to sheet 26, the inner cover sheet 28 is provided with its own fastening means 38 and 40, each being secured longitudinally along the outer respective edges of the cover sheet 28. However, fastening means 38 comprises a first fastening fabric strip **38*a* which is attached from one end of sheet 28 to the center fold line indicated at a—a; and a second fastening fabric strip 38*a* is attached in the same manner to sheet 28, one strip being a male section and the opposite strip being a female section (also preferably of Velcro), whereby the strips lock together when the enclosure is folded as seen in FIGS. 1 and 4. Fastening means 40 also comprises a male section and a female section, as indicated at 40*a* and 40*b***.

Cover sheets 26 and 28 are thereafter sewn together along their contacting edges, as indicated at 42, filler 30 being interposed therebetween as seen in FIG. 4. An elongated rectangular sleeping cover is thus formed having half sections **24*a* and 24*b* which are folded over themselves, whereby the inner cover sheet 28 is also folded over itself, as illustrated in FIGS. 1 and 3. When folded, the free open ends 44 should be aligned with each other to define the open head end of the enclosure, the folded end 45** defining the closed foot end thereof.

If one wishes to be substantially enclosed between the folded half sections **24*a* and 24*b* of sleeping enclosure 24, he fastens the mating longitudinal strips together. (See FIG. 4.) Thus, the user thereof merely folds down one corner or side. (See FIG. 1**.) After one is comfortably positioned between the half sections, he fastens the remaining strips together. Or, one can sleep between the half sections without fastening any of the strips, if he or she so chooses.

It is contemplated that the fabric utilized for top mattress cover 14, which defines the fitted bedspread, be comprised of any suitable material that will be color and design coordinated with the outer and inner cover sheets 26 and 28, respectively. It is further contemplated that a matching pillow case 50 will be incorporated as part of the complete bed set.

Further, it is to be understood that the size and shape of bedspread 12 will be determined by the particular mattress size and shape.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A combination bedspread and sleeping enclosure, comprising:

a bedspread adapted to be form-fitted over a mattress;

a sleeping enclosure having an open head end, and a closed foot end, and longitudinal open sides, said enclosure being formed to be positioned on said bedspread;

said sleeping enclosure comprising a single, elongated, rectangular body cover adapted to be transversely folded into first and second half sections, whereby said closed foot end is defined along the transverse fold;

means interposed between said bedspread and said sleeping enclosure for removably securing said sleeping enclosure to said bedspread said removable securing means comprising a first securing fabric-strip member affixed transversely to said body cover adjacent said folded closed foot end; and a second securing fabric-strip member transversely affixed to said bedspread adjacent one end thereof; whereby said first and second securing strips are adapted to engage each other to fasten said sleeping enclosure to said bedspread; and means formed along said longitudinal open sides of said sleeping enclosure for coupling the respective edges of said open sides to a closed position.

2. The combination as recited in claim 1, wherein said coupling means comprises:

a first set of coupling fabric-strip members, attached in a contiguous manner along one edge of said inner cover sheet; and a second set of coupling fabric-strip members attached in a contiguous manner along the opposite side of said inner cover sheet; and wherein each of said sets includes a male strip member and an engaging female strip member.

3. The combination as recited in claim 1, wherein said bedspread comprises:

a fitted top-mattress-cover member; and depending side-mattress-cover members.

4. The combination as recited in claim 3, wherein said depending side members include a continuous elastic band secured along the peripheral edge thereof; and wherein said combination includes a matching pillow case.

* * * * *